US010663252B1

(12) United States Patent
Sprainis et al.

(10) Patent No.: US 10,663,252 B1
(45) Date of Patent: May 26, 2020

(54) SHOULDER-FIRED FIREARM PRIMARY AND SECONDARY RECOIL ATTENUATOR

(71) Applicants: John M. Sprainis, Springfield, OR (US); Ronald J. Sprainis, Springfield, OR (US)

(72) Inventors: John M. Sprainis, Springfield, OR (US); Ronald J. Sprainis, Springfield, OR (US)

( * ) Notice: Subject to any disclaimer, the term of this patent is extended or adjusted under 35 U.S.C. 154(b) by 0 days.

(21) Appl. No.: 16/211,102

(22) Filed: Dec. 5, 2018

Related U.S. Application Data

(60) Provisional application No. 62/599,257, filed on Dec. 15, 2017.

(51) Int. Cl.
*F41C 23/06* (2006.01)
*F41C 23/08* (2006.01)

(52) U.S. Cl.
CPC ..... *F41C 23/06* (2013.01); *F41C 23/08* (2013.01)

(58) Field of Classification Search
CPC ..... F41C 23/06; F41C 23/08
USPC ..... 42/1.06, 74, 72
See application file for complete search history.

(56) References Cited

U.S. PATENT DOCUMENTS 247,451 A * 9/1881 White ..... F41C 23/06 42/74
311,755 A * 2/1885 Hermle ..... F41C 23/06 42/74
480,587 A * 8/1892 Townsend ..... F41C 23/06 42/74
524,458 A * 8/1894 Blake ..... F41C 23/08 42/74
935,163 A * 9/1909 Parker ..... F41C 23/06 42/74
1,042,132 A * 10/1912 Long ..... F41C 23/08 42/74
1,213,951 A * 1/1917 Ringsmith ..... F41C 23/08 42/74
1,255,566 A * 2/1918 Pearson ..... F41C 23/08 42/74
1,307,529 A * 6/1919 Werndl ..... F41C 23/06 42/74

(Continued)

FOREIGN PATENT DOCUMENTS

SI 1348928 5/2011

*Primary Examiner* — Joshua E Freeman
(74) *Attorney, Agent, or Firm* — Jerry Haynes Law

(57) ABSTRACT

A shoulder-fired firearm primary and secondary recoil attenuator mounts on the butt of a shoulder-fired firearm to absorb both the primary and secondary recoil impulses with distinct spring rates and viscoelastic hysteresis. The attenuator may include a mount plate attachable to a butt of a shoulder-fired firearm. A shoulder plate may be disposed in a spaced-apart, parallel relationship with the mount plate. At least one damper may be disposed between the mount plate and the shoulder plate. The at least one damper may include a viscoelastic copolymer elastomer material having a hollow body elastomer construction. The viscoelastic copolymer elastomer material may be shape-engineered to exhibit time-dependent strain. Accordingly, the at least one damper may have distinct spring rates in response to a primary recoil impulse caused by acceleration of a bullet traveling through a firearm barrel and a secondary recoil impulse caused by ejection of the gases exiting the firearm barrel.

4 Claims, 5 Drawing Sheets

(56) References Cited

U.S. PATENT DOCUMENTS 1,334,467 A * 3/1920 Moller ..... F41C 23/06 42/74
1,785,977 A * 12/1930 Pruyn ..... F41C 23/06 42/74
1,964,649 A * 6/1934 Stetson ..... F41C 23/06 42/74
2,455,438 A * 12/1948 Oppold ..... F41C 23/06 42/74
3,019,543 A * 2/1962 Ducharme ..... F41C 23/06 42/74
3,233,354 A * 2/1966 Ahearn ..... F41C 23/06 42/74
3,371,442 A * 3/1968 Carlson ..... F41C 23/06 42/74
3,405,470 A * 10/1968 Wesemann ..... F41C 23/06 42/74
3,707,797 A * 1/1973 Ruth ..... F41C 23/06 42/74
3,852,904 A * 12/1974 Drevet ..... F41C 23/08 42/74
4,198,037 A 4/1980 Anderson
4,439,943 A * 4/1984 Brakhage ..... F41C 23/06 42/74
4,663,877 A * 5/1987 Bragg ..... F41C 23/14 42/71.01
4,769,937 A * 9/1988 Gregory ..... F41C 23/06 42/74
4,910,904 A * 3/1990 Rose ..... F41C 23/06 42/73
4,922,641 A * 5/1990 Johnson ..... F41C 23/06 42/74
5,353,681 A 10/1994 Snugg
5,669,168 A 9/1997 Perry
6,305,115 B1 10/2001 Cook
7,926,216 B2 4/2011 Bentley
8,286,382 B2 10/2012 Vesligai
10,156,422 B1 * 12/2018 Valin ..... F41C 23/20
2002/0088161 A1 * 7/2002 Sims ..... F41C 23/08 42/74
2003/0154640 A1 * 8/2003 Bragg ..... F41C 23/08 42/74
2003/0226304 A1 * 12/2003 Murello ..... F41C 23/08 42/74
2004/0144011 A1 * 7/2004 Vignaroli ..... F41C 23/08 42/74
2005/0246931 A1 * 11/2005 Poff, Jr. ..... F41C 23/06 42/1.06
2006/0096148 A1 * 5/2006 Beretta ..... F41C 23/06 42/74
2006/0254112 A1 * 11/2006 Snoderly ..... F41C 23/06 42/74
2010/0281727 A1 * 11/2010 Quaedpeerds ..... F41C 23/06 42/1.06
2011/0113666 A1 5/2011 Latimer
2011/0138668 A1 * 6/2011 Thomas ..... F41C 23/06 42/1.06
2012/1067432 7/2012 Howe et al.
2013/0145668 A1 * 6/2013 Valin ..... F41C 23/08 42/74
2013/0174461 A1 * 7/2013 Ballard ..... F41C 23/08 42/74
2014/0075801 A1 3/2014 Moretti
2014/0109452 A1 * 4/2014 Baker ..... F41C 23/06 42/1.06
2017/0115085 A1 4/2017 Johnson et al.
2017/0356717 A1 * 12/2017 Pollutro ..... F41C 23/20
2018/0017353 A1 * 1/2018 Lesenfants ..... F41C 23/06

* cited by examiner

SHOULDER-FIRED FIREARM PRIMARY AND SECONDARY RECOIL ATTENUATOR

CROSS-REFERENCE TO RELATED APPLICATIONS

This application claims the benefit of U.S. provisional application No. 62/599,257, filed Dec. 15, 2017 and entitled SHOULDER-FIRED FIREARM PRIMARY AND SECONDARY RECOIL ATTENUATOR, which provisional application is hereby incorporated by reference herein in its entirety.

FIELD OF THE INVENTION

The present invention relates generally to a shoulder-fired firearm primary and secondary recoil attenuator adapted to mount on the butt of a shoulder-fired firearm. More so, the invention teaches a shoulder-fired firearm recoil attenuator that mounts to the butt of the firearm and absorbs both the primary and secondary recoil impulses when the firearm is fired; the molecular structure being oriented as a result of compression of the material (shape engineering) such as a copolymer elastomer and shape engineered to exhibit time-dependent strain that provides recoil damping; whereby the copolymer viscoelastic damper comprises a material molecular structure that compresses a minimum of 40% of normal dimensions during recoil and returns to normal dimensions; whereby the configuration and performance of the damper is tailorable through use of a design database.

BRIEF DESCRIPTION OF THE DRAWINGS

The invention will now be described, by way of example, with reference to the accompanying drawings, in which:

FIG. 1A shows a side view of the attenuator mounted to the butt of a firearm, and FIG. 1B shows a close up side view of the attenuator, in accordance with an embodiment of the present invention;

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

Figure 1A:
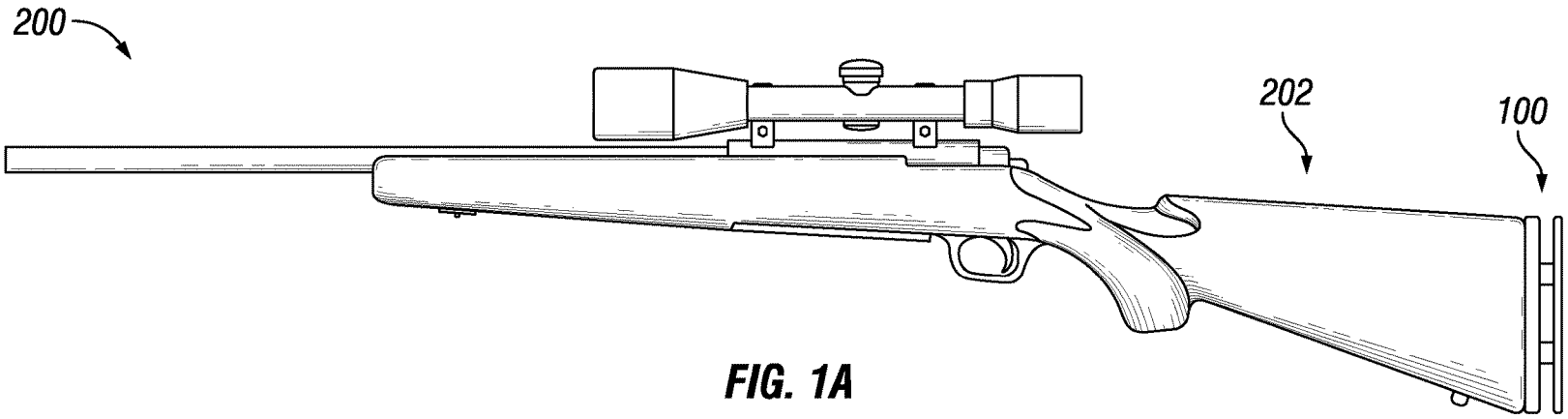
FIGS. 1A and 1B illustrate an exemplary shoulder-fired firearm primary and secondary recoil attenuator, where
Figure 9:
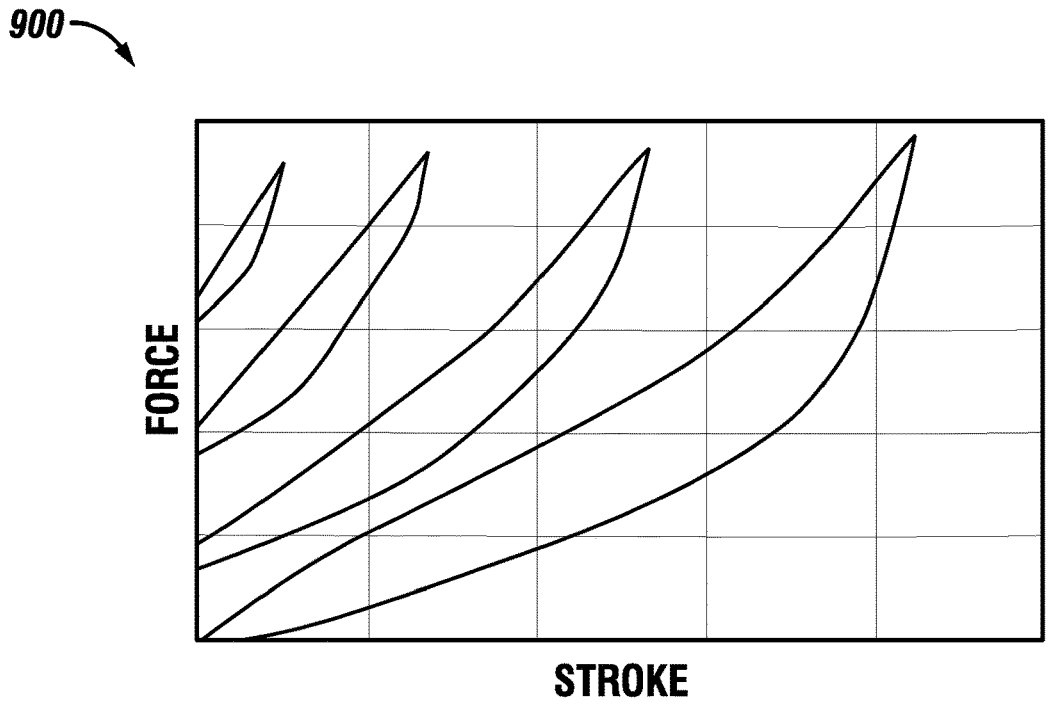
FIG. 9 illustrates a graph illustrating how the force at which damping occurs can be adjusted, in accordance with an embodiment of the present invention.

An illustrative embodiment of a shoulder-fired firearm primary and secondary recoil attenuator 100 is referenced in FIGS. 1A-5. The shoulder-fired firearm primary and secondary recoil attenuator 100, hereafter "attenuator 100", is adapted to mount on the butt 202 of a shoulder-fired firearm 200, as illustrated in FIGS. 1A and 1B, to absorb both the primary and secondary recoil impulses when the firearm 200 is discharged. The attenuator 100 may have two distinct spring rates, one being "stiff" during primary recoil and the other being "softer" during secondary recoil of the firearm 200. The spring rates of the attenuator 100 may improve accuracy or reduce the adverse effect on accuracy which a rigid butt plate would have on the firearm 200. In some embodiments, the attenuator 100 may be tailored to achieve different spring rates during primary and secondary recoil impulses responsive to firing of the firearm 200. FIG. 9 shows a graph 900 illustrating a typical preload adjustability profile for the attenuator 100.

Figure 1B:
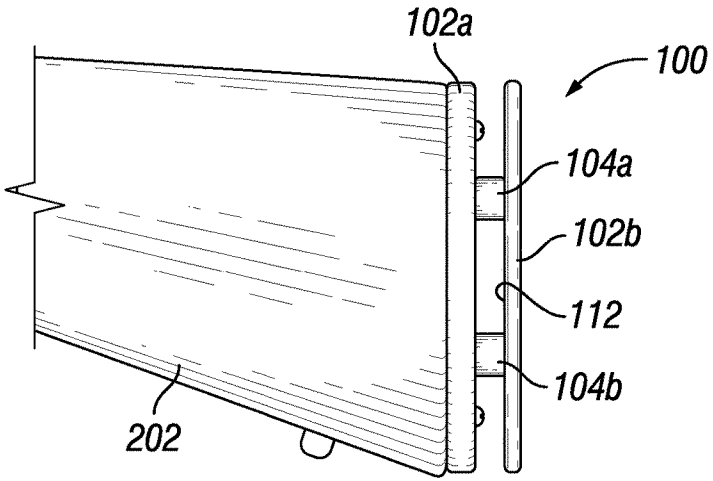

As illustrated in FIG. 1B, the attenuator 100 may include a mount plate 102*a* and a shoulder plate 102*b* that are disposed in spaced-apart, parallel relationship to each other. The plates 102*a*, 102*b* may be separated or spanned by or sandwiched between at least one damper 104*a*, 104*b*. In some embodiments, the damper 104*a*, 104*b* may be mounted between the mount plate 102*a* and the shoulder plate 102*b* using at least one damper fastener 114*a*, 114*b*. Each damper fastener 114*a*, 114*b* may be extended through a corresponding pair of damper fastener openings (not illustrated) in the respective mount plate 102*a* and shoulder plate 102*b*. The mount plate 102*a* may affix the attenuator 100 to the butt 202 of the firearm 200 typically as will be hereinafter described. The mount plate 102*a* may transfer at least one recoil load from the firearm butt 202 to the damper 104*a*, 104*b*, which may absorb most of the recoil load and transmit the remainder of the load to the shoulder plate 102*b*, and finally to the shoulder of the firearm shooter. The distance between the plates 102*a*, 102*b* may provide sufficient spacing to allow the damper 104*a*, 104*b* to compress and thereby absorb the recoil impulse energy from the firearm 200.

Figure 2:
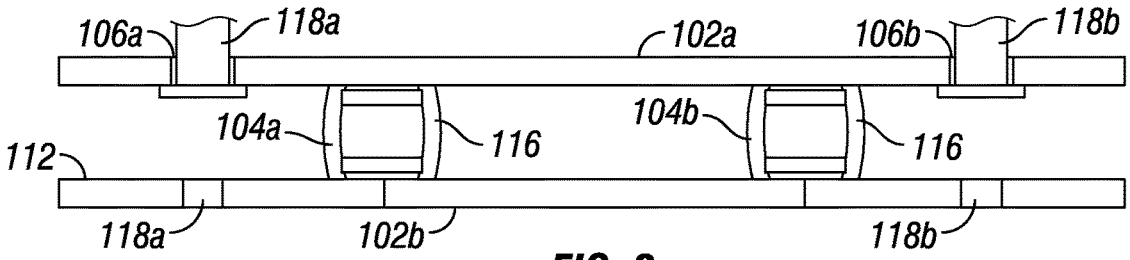
FIG. 2 illustrates an elevated side view of the shoulder-fired firearm primary and secondary recoil attenuator, in accordance with an embodiment of the present invention.

The damper 104*a*, 104*b* may be fabricated from a viscoelastic copolymer elastomer material having a hollow body elastomer construction, as illustrated in FIG. 2. The typically hollow body elastomer construction of the damper 104*a*, 104*b* may include a material molecular structure that compresses more than 50% of the normal dimensions, length or volume of the damper 104*a*, 104*b* upon recoil of the firearm 200 while still retaining structural integrity. In some embodiments, the damper 104*a*, 104*b* may include a viscoelastic copolymer elastomer material having a hollow body elastomer construction with a ratio of plastic strain to elastic strain greater than 1.5 to 1. As illustrated in FIG. 2, the damper 104*a*, 104*b* may have oriented wall sections that include a bend 116 as a result of axial pre-compression. The damper 104*a*, 104*b* is unique in that it compresses for both a primary recoil of the firearm 200, caused by acceleration of a bullet traveling through the barrel of the firearm 200, and a secondary recoil caused by ejection of the gases exiting the barrel of the firearm 200. The attenuator 100 may have different spring rates for the primary and secondary recoils.

Figure 8:
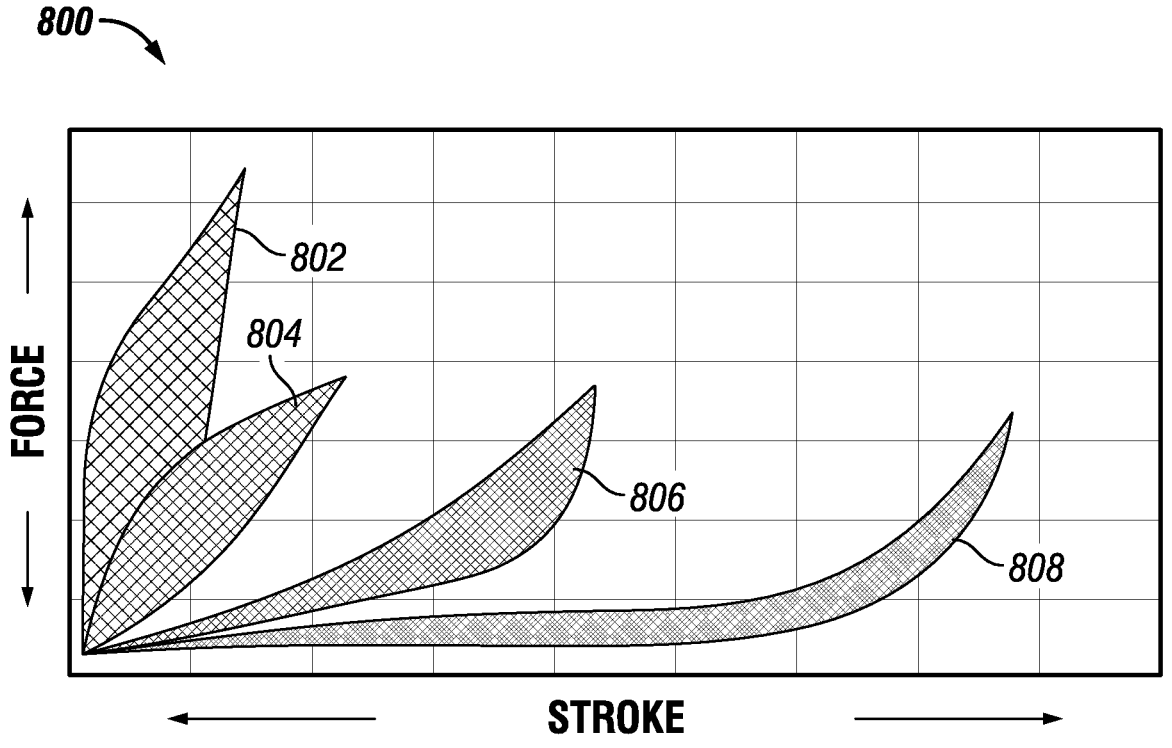
FIG. 8 illustrates a graph illustrating the different types of force vs. compression that can be created through the design database of damper attribute algorithms, in accordance with an embodiment of the present invention.

The damper 104*a*, 104*b* may be shape-engineered to exhibit a time-dependent strain that provides the double recoil cushioning while also protecting against wear and tear. The viscoelastic material of the damper 104*a*, 104*b* may be manufactured using a damper design database that enables customizable dimensions for the damper 104*a*, 104*b*. The shape engineering process may not, however, change the composition of the material of the damper 104*a*, 104*b*, but rather the shape of the damper 104*a*, 104*b* and the shape of the force-travel curve of the damper 104*a*, 104*b*, as shown in FIG. 8.

In one aspect, a shoulder-fired firearm primary and secondary recoil attenuator 100 may include:

A shoulder-fired firearm primary and secondary recoil attenuator, the attenuator comprising:

- a mount plate 102*a* attachable to a butt 202 of a shoulder-fired firearm 200;
- a shoulder plate 102*b* disposed in a spaced-apart, parallel relationship with the mount plate 102*a*; and
- at least one damper 104*a*, 104*b* disposed between the mount plate 102*a* and the shoulder plate 102*b*, the at least one damper 104*a*, 104*b* comprising:
  - a viscoelastic copolymer elastomer material having a hollow body elastomer construction,
  - the viscoelastic copolymer elastomer material being shape-engineered to exhibit time-dependent strain,
  - whereby the at least one damper 104*a*, 104*b* has distinct spring rates in response to a primary recoil impulse caused by acceleration of a bullet traveling through a firearm barrel, and a secondary recoil impulse caused by ejection of the gases exiting the firearm barrel.

In another aspect, the attenuator 100 may be developed via a damper design database which enables tailorable shape and dimensions for the damper 104*a*, 104*b*.

In another aspect, the mount plate 102*a* may transfer recoil load from the firearm butt 202 to the damper 104*a*, 104*b* and to the shoulder plate 102*b*, respectively.

In another aspect, the distance between the mount plate 102*a* and the shoulder plate 102*b* may form a plate space 112 which allows the damper 104*a*, 104*b* to compress.

One objective of the present invention is to reduce the dynamic load on the shoulder of a shoulder-fired firearm user while discharging the firearm 200, caused by the recoil of the firearm 200.

Another objective is to improve the ballistic characteristics of the shoulder-fired firearm 200 by reducing recoil forces during discharge.

Another objective is to dampen both the primary recoil caused by the acceleration of a bullet traveling through a firearm barrel and a secondary recoil caused by the ejection of the gases exiting the firearm barrel.

Another objective is to facilitate distinct spring rates for primary recoil caused by the acceleration of a bullet traveling through a firearm barrel, and a secondary recoil caused by the ejection of the gases exiting the firearm barrel.

Another objective is to dampen the recoil characteristics of a firearm without use of a spring or moving mechanical parts.

Another objective is to absorb recoil energy in less weight and space than hydraulic, urethane, or rubber recoil absorbing devices.

Another objective is to absorb more recoil energy in a smaller space, for a minimal impact on component packaging, so that minimal firearm stock modification is required.

Another objective is to construct the viscoelastic material from a proprietary molecular orientation process that greatly enhances the strength and durability of the damper 104*a*, 104*b*, up to 10 times than that for rubber and 20 times that for urethane.

Another objective is to provide a simple installation of the attenuator 100 on the firearm butt 202 on a firearm 200 which may be accomplished with at least one plate fastener 118*a*, 118*b* passing through at least one aperture 106*a*, 106*b* in the mount plate 102*a*.

Those skilled in the art will recognize that firearm recoil pads extend rearward from the rear of a rifle stock. The pads are often configured to absorb recoil impulse when the firearm is fired. Many of these pads are constructed from closed cell foamed viscoelastic materials. Further, many pads are constructed from urethane and other TPE (thermoplastic elastomers) viscoelastic materials. These materials are prone to fail if compressed more than approximately 38% of their original length. The present invention is easily installed on the butt 202 of a shoulder-fired firearm 200 and constructed from a viscoelastic material having a hollow body elastomer configuration and may further be compressible to more than fifty percent of the original dimensions, length or volume.

Figure 3:
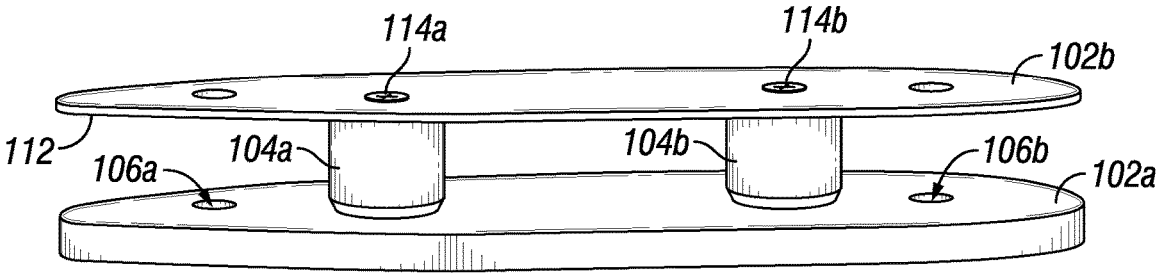
FIG. 3 illustrates a side perspective view of the shoulder-fired firearm primary and secondary recoil attenuator, in accordance with an embodiment of the present invention.
Figure 5:
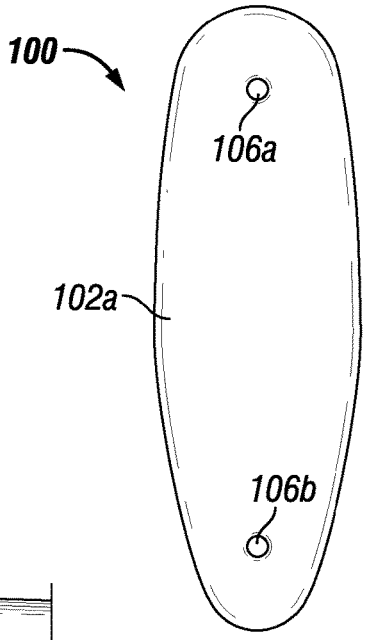
FIG. 5 illustrates a top view of the shoulder-fired firearm primary and secondary recoil attenuator, in accordance with an embodiment of the present invention.

As FIG. 3 references, the attenuator 100 may include a mount plate 102*a* attachable to a butt 202 of a shoulder-fired firearm 200. The mount plate 102*a* may be flat, elongated, and may conform or be complementary to the shape of the butt 202 of the shoulder-fired firearm 200. In some embodiments, this may include an elliptical shape. As illustrated in FIG. 5, in one embodiment, the mount plate 102*a* may have at least two apertures 106*a*, 106*b*. The apertures 106*a*, 106*b* may enable passage of at least one screw or other fastening mechanism or plate fastener 118*a*, 118*b* (FIG. 2) that facilitate attachment of the mount plate 102*a* to the butt 202 of the firearm 200 as the plate fasteners 118*a*, 118*b* typically engage interiorly-threaded fastener openings (not illustrated) in the butt 202 of the firearm 200. Alternative fastening mechanisms or techniques which may be used to attach the mount plate 102*a* to the firearm butt 202 include but are not limited to clips, clamps and brackets. Suitable materials for the mount plate 102*a* may include, without limitation, a rigid polymer, metal, and rubber.

Figure 4:
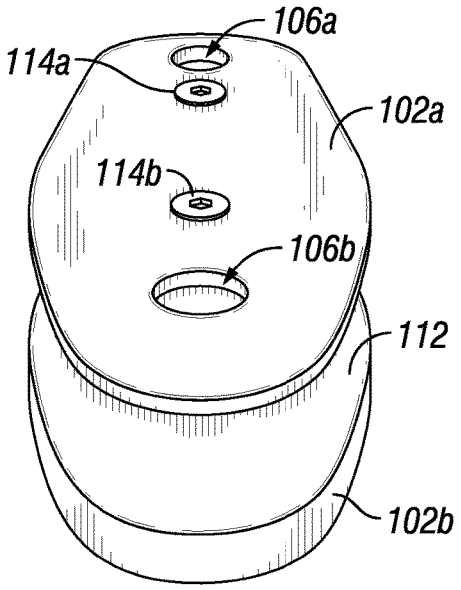
FIG. 4 illustrates a front perspective view of the shoulder-fired firearm primary and secondary recoil attenuator, in accordance with an embodiment of the present invention.

Turning now to FIG. 4, a shoulder plate 102*b*, which may have substantially the same shape and dimensions as the mount plate 102*a*, is disposed in a spaced-apart, parallel relationship with the mount plate 102*a*. A plate space 112 may be defined by and between the mount plate 102*a* and the shoulder plate 102*b*. The shoulder plate 102*b* may be flat and elongated and may have an elliptical shape. In typical operation of the attenuator 100, which will be hereinafter described, the shoulder plate 102*b* may rest against the shoulder of a firearm shooter (not illustrated) during discharge of the firearm 200. Suitable materials for the shoulder plate 102*b* may include, without limitation, a rigid polymer, metal, and rubber. Other suitable materials for the shoulder plate 102*b* may include closed cell foam urethane or other thermoplastic elastomers (TPE).

As referenced in FIG. 3, at least one damper 104*a*, 104*b* may be disposed between the mount plate 102*a* and the shoulder plate 102*b*, spanning the plate space 112. In some embodiments, the dampers 104*a*, 104*b* may include two exposed cylindrical columns disposed perpendicular to the plates 102*a*, 102*b*. In other embodiments, the dampers 104*a*, 104*b* may be shielded by a foam boot (not illustrated) that may have same shape as the plates 102*a*, 102*b*. The plates 102*a*, 102*b* and the dampers 104*a*, 104*b* may work together to transfer recoil load from the butt 202 of the firearm 200 to the shoulder of the firearm shooter. In one embodiment, the mount plate 102*a* may transfer recoil loads from the butt 202 to the dampers 104*a*, 104*b*, and the dampers 104*a*, 104*b* may absorb some or most of the recoil loads and transfer the remaining loads to the shoulder plate 102*b*. The resilient and typically aluminum, hard plastic, or polymer composition of the plates 102*a*, 102*b* may help transfer the recoil load.

Figure 6:
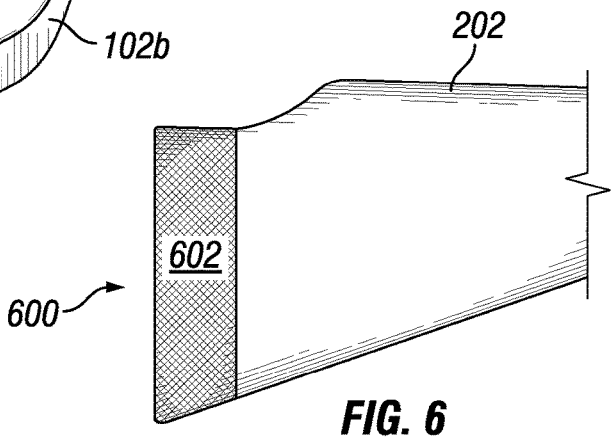
FIG. 6 illustrates an alternative embodiment of the shoulder-fired firearm attenuator, in accordance with an embodiment of the present invention.

Looking now at FIG. 6, an alternative embodiment of the attenuator 600 provides an outer panel 602 that encapsulates the plates 102*a*, 102*b* and the dampers 104*a*, 104*b*. The outer panel 602 may include a resilient plastic casing or simply a tape that covers or encloses the plate space 112 between the plates 102*a*, 102*b*. In this alternative embodiment, the at least one damper 104*a*, 104*b* and the plates 102*a*, 102*b* may operate in substantially the same manner, transferring primary and secondary recoil loads from the butt 202 of the firearm 200 to the shoulder of the firearm shooter in a controlled manner. This alternate design may utilize foam and/or plastic for the plates 102*a*, 102*b*.

In any case, the damper 104*a*, 104*b* may be the primary component that compresses in response to discharge of the firearm 200 to absorb some or most of the primary and secondary recoil impulses from the firearm 200. The damper 104*a*, 104*b* may be compressible in response to a primary recoil caused by the acceleration of a bullet traveling through the barrel of the firearm 200, and a secondary recoil caused by ejection of the gases exiting the barrel. Compression of the damper 104*a*, 104*b* may occur in two distinct impulses, with the higher spring rate typically occurring during primary recoil and the lower spring rate typically occurring during secondary recoil.

In some embodiments, the damper 104*a*, 104*b* may be fabricated from a viscoelastic material having a hollow body elastomer configuration. The energy absorption of the damper 104*a*, 104*b* may be accomplished via internal resistance to strain from shear between the polymer molecular chains in the damper 104*a*, 104*b*.

Those skilled in the art will recognize that a viscoelastic damper 104*a*, 104*b* may be fabricated substantially from a viscoelastic material, which is a material that exhibits both viscous and elastic characteristics when undergoing deformation. In essence, the viscoelastic damper 104*a*, 104*b* may act like a spring and damper system, and in certain cases may approximate the performance of an ideal hydraulic damper.

Furthermore, the typically hollow body elastomer configuration of each damper 104*a*, 104*b* of the present invention may be shape-engineered to exhibit a time-dependent strain. The viscoelastic damper 104*a*, 104*b* may have a unique material molecular structure. Through the shape engineering process, the molecular structure may be oriented such that under deformation, the damper 104*a*, 104*b* retains its integrity after every recoil.

Figure 7:
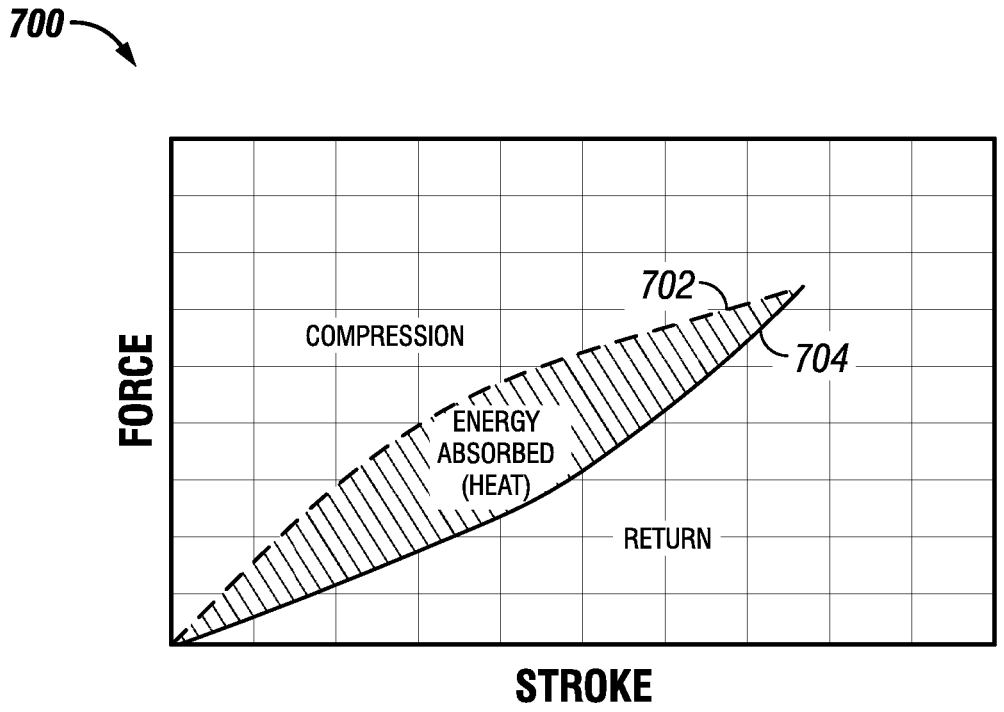
FIG. 7 illustrates a graph illustrating force versus compression after shaped engineering of an exemplary viscoelastic damper, in accordance with an embodiment of the present invention.

As discussed above, the viscoelastic material may be compressible to more than 50% of the dimensions, length or volume of the damper 104*a*, 104*b*. Evidence of the compressibility of the dampers 104*a*, 104*b* is shown in FIG. 7, which shows a graph 700 of a Force vs. Stroke curve. This graph 700 illustrates the performance of the viscoelastic material design. The difference between the compression curve 702 and the return curve 704 is the energy absorbed or heat generated by the damper 104*a*, 104*b*. The compression curve 702 and the return curve 704 slope upwardly, indicating that as recoil forces increase, the resistance to compression also increases.

The Force vs. Stroke curve of the graph 700 illustrates the ability of the attenuator 100 to absorb energy. Essentially, the molecular structure of the elastomer damper 104*a*, 104*b* resists deformation as internal friction is generated between the polymer chains in the damper 104*a*, 104*b*. There is thus hysteresis between the compression curve 702 and the return curve 704, corresponding to the absorbed energy or energy converted to heat, as illustrated in FIG. 7.

The shape engineering of the viscoelastic material of the damper 104*a*, 104*b* may include a process of shaping the viscoelastic material to the desired shape between the mount plate 102*a* and the shoulder plate 102*b*. The shape engineering may orient the molecular structure in such a way as to achieve specific performance in the force vs travel performance and hysteresis. The damper design database may include numerous saved data points so as to enable multiple shapes of the viscoelastic material to be achieved.

Looking now at FIG. 8, a graph 800 illustrates the different spring rates and differences in hysteresis between various designs of the damper 104*a*, 104*b*. Also referenced are the different shapes of force vs. compression curves that can be created through use of the damper attribute algorithms in the damper design database. Damper A has the least travel but has can withstand the highest peak compressive force and has a large amount of hysteresis or energy converted to heat in the elastomer body. Damper A also has the highest spring rates. Damper B is similar to damper A but withstands a lesser peak compressive force and lower spring rates. Damper C withstands a similar peak compressive force but has more travel and lower spring rates. Damper D has the greatest travel, withstands the lowest peak compression and has the lowest spring rates. All dampers in FIG. 8 are compressed by at least 40% of their original length. Thus, the viscoelastic damper can be tailored to a specific firearm 200 and/or firearm user.

Thus, graph 800 shows the different spring rates and hysteresis between the attenuator designs. For example, curve A is a very short damper before deformation but is still compressed >40%; thus, it has much less travel than damper D. All of the dampers 104*a*, 104*b* may be compressed more than 40% to create the shape-engineered design. On the graph 800, the stroke axis is in terms of displacement and not a percentage of initial length.

FIG. 9 shows another graph 900 that illustrates adjustment of the force at which damping occurs to create numerous advantages from the viscoelastic material of the damper 104*a*, 104*b*. Graph 900 displays the force vs. travel performance of a specific damper 104*a*, 104*b* at different preloads. The graph 900 shows that for higher preload forces, the force at which damp energy begins, or travel of the damper 104*a*, 104*b* past the damper's installed length, is also higher. The purpose of this adjustability is to prevent a pulpous damper 104*a*, 104*b* upon sighting a target through the firearm 200. A pulpous damper 104*a*, 104*b* may negatively affect sighting accuracy and, in addition, may negatively affect re-acquisition of a target after successive firings of the firearm 200. Pre-loading the damper 104*a*, 104*b* may help to prevent this issue.

In yet another advantage that can be achieved by adjusting the shape of the viscoelastic material, the damper 104*a*, 104*b* may be configured to absorb energy in less weight and space than hydraulic, urethanes, or rubbers. Also, the damper 104*a*, 104*b* may absorb a larger quantity of energy in a smaller space, for a minimal impact on component packaging. In this manner, minimal firearm stock modification is required. These multiple shapes are possible because the damper 104*a*, 104*b* is constructed from a proprietary molecular orientation process that greatly enhances the strength and durability of the damper 104*a*, 104*b*, which in some embodiments can be up to 10 times that of rubber and 20 times that of urethane. The shape engineering process may change the shape of the damper 104*a*, 104*b* and the shape of the force-travel curve, as shown in FIG. 8, rather than the composition of the material of which the damper 104*a*, 104*b* is fabricated.

Thus, the present invention teaches an actuator 100 that has many advantages over conventional damper designs. This is depicted in the graph 1000, shown in FIG. 10. Graph 1000 illustrates a comparison of conventional hydraulic dampers available on the market. Graph 1000 shows where primary recoil is occurring and how the slope (can be defined as the spring rate) of the curve appears during primary recoil and secondary recoil of the firearm 200. Graph 1000 shows a stiffer (higher spring rate) during primary recoil and a softer (lower spring rate) during secondary recoil. The hydraulics are very soft during primary recoil and target acquisition, adversely affecting accuracy. The design can be tailored through rotation of the damper fasteners 114*a*, 114*b* in the damper fastener apertures (not illustrated) which extend through the respective mount plate 102*a* and the shoulder plate 102*b*.

Figure 10:
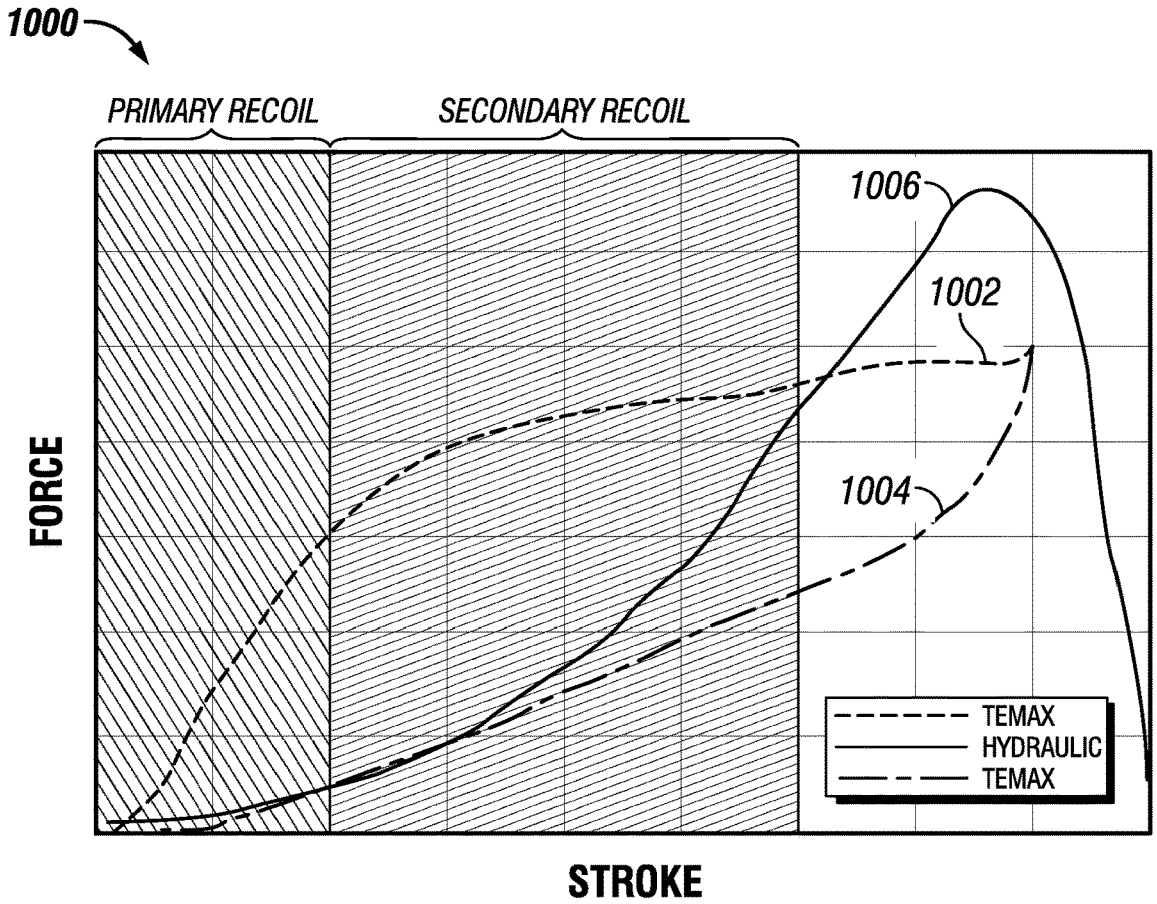
FIG. 10 illustrates a graph illustrating the comparison of hydraulic dampers showing primary and secondary recoil, in accordance with an embodiment of the present invention.

As shown in the graph 1000 of FIG. 10, the damper compression line 1002 for the first or primary recoil, such as may be achieved using a TEMAX (trademark) recoil pad, has a steep front-end rate that levels out during the secondary recoil. This may create a stiff feel for the damper. The damper release line 1004 represents the force returned to the system after the primary recoil. The integral between the damper compression line 1002 and the damper release line 1004 is the energy absorbed by the damper or converted to heat. The hydraulic damper line 1006 is not as effective in damping the primary recoil and is very pulpous, and in absorbing energy from the secondary recoil, still does not match the performance of the damper 104*a* of the attenuator 100.

Another advantage provided by the attenuator 100 of the present invention is that the damper 104*a*, 104*b* may form a solid state recoil pad which absorbs maximum quantities of recoil energy while requiring little or no maintenance. For example, the damper 104*a*, 104*b* may not require steel coil springs or hydraulic fluids, and thus, exhibits significantly fewer failure modes. Yet another advantage provided by the attenuator 100 of the present invention is the easy installation of the mount plate 102*a* to the butt 202 of the firearm 200, unlike conventional hydraulic recoil pads.

Despite its significant compression, the damper 104*a*, 104*b* has a long life expectancy due to its unique shape-engineering capacity. This life expectancy is significantly longer and more resilient than conventional hydraulic pads, which are mechanical and thus require maintenance. Furthermore, the damper 104*a*, 104*b* is lightweight and may be fabricated primarily of lightweight foams and plastics. By offering such simplicity, very few components are needed for the attenuator 100, necessitating a limited number of failure modes.

In typical application of the attenuator 100, the mount plate 102*a* may be attached to the firearm butt 202 of the firearm 200. In some embodiments, this may be accomplished by extending attenuator mount fasteners (not illustrated) through the respective apertures 106*a*, 106*b* in the mount plate 102*a* and threading the attenuator mount fasteners into respective fastener openings (not illustrated) in the firearm butt 202. In other embodiments, the mount plate 102*a* may be attached to the firearm butt 202 using clips, clamps brackets and/or other suitable attachment mechanism.

Preparatory to firing the firearm 200, a firearm shooter (not illustrated) may place the mount plate 102*a* of the attenuator 100 against the shooter's shoulder. The shooter may then fire the firearm 200. As it travels through the barrel of the firearm 200, the bullet creates a primary recoil which causes the firearm butt 202 to travel rearwardly against the damper 104*a*, 104*b*. Accordingly, as the mount plate 102*a* travels toward the shoulder plate 102*b*, the damper 104*a*, 104*b* is compressed and may shorten at least about 50% of its length. The shortening damper 104*a*, 104*b* may absorb some or most of the primary recoil pressure of the primary recoil and transmit the remaining primary recoil pressure against the shoulder plate 102*b*. The shoulder plate 102*b* may, in turn, apply a minimal magnitude of the primary recoil pressure against the shoulder of the firearm shooter. The damper 104*a*, 104*b* may then recoil back to the pre-compression length as the mount plate 102*a* travels away from the shoulder plate 102*b*.

As the gases from the ejected bullet subsequently travel through and are ejected from the forearm barrel, the gases create a secondary recoil which causes the firearm butt 202 to travel rearwardly against the damper 104*a*, 104*b*. The mount plate 102*a* thus travels toward the shoulder plate 102*b* and the damper 104*a*, 104*b* is compressed to absorb the secondary recoil pressure. The shortening damper 104*a*, 104*b* may absorb some or most of the secondary recoil pressure and transmit the remaining secondary recoil pressure against the shoulder plate 102*b*. The shoulder plate 102*b* may, in turn, apply a minimal magnitude of the secondary recoil pressure against the shoulder of the firearm shooter. The damper 104*a*, 104*b* may then again recoil back to the pre-compression length as the mount plate 102*a* travels away from the shoulder plate 102*b*. Because the viscoelastic material of the damper 104*a*, 104*b* may be shape-engineered to exhibit time-dependent strain, the damper 104*a*, 104*b* may have distinct spring rates in response to the primary recoil impulse and the secondary recoil impulse.

Figure 11:
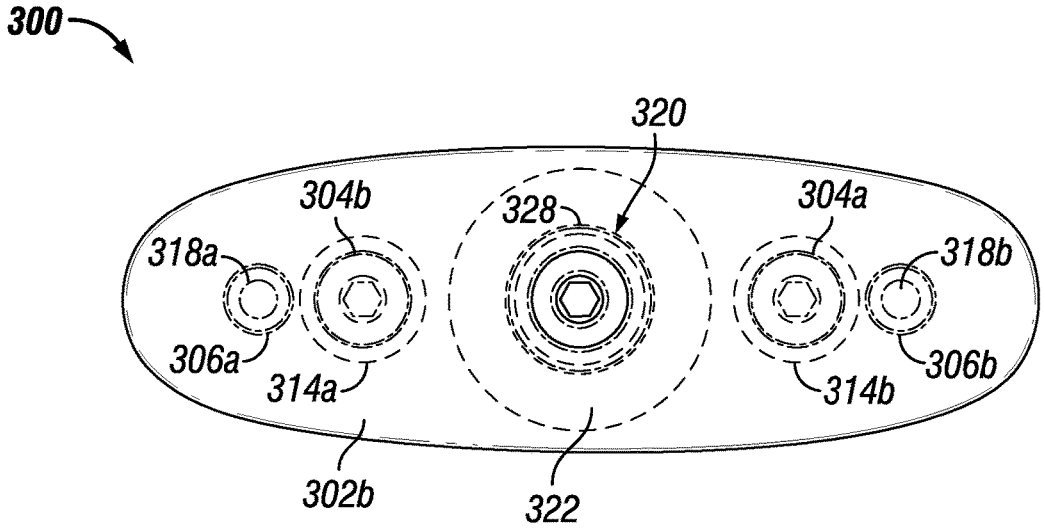
FIG. 11 illustrates a rear view of the shoulder-fired firearm primary and secondary recoil attenuator, in accordance with an embodiment of the present invention.
Figure 12:
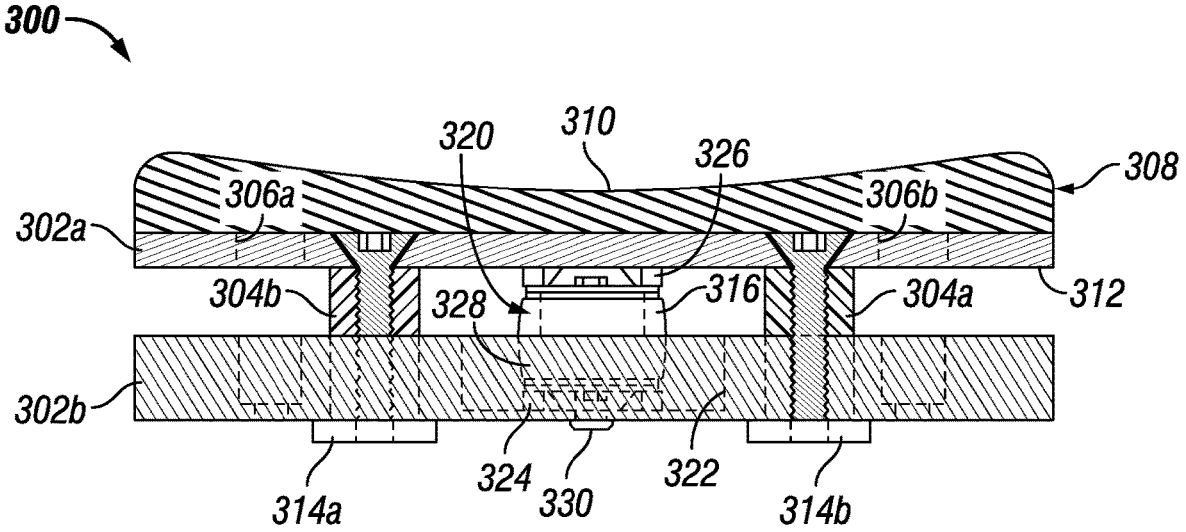
FIG. 12 illustrates a side view of the shoulder-fired firearm primary and secondary recoil attenuator, in accordance with an embodiment of the present invention.

Referring next to FIGS. 11 and 12, another illustrative embodiment of the attenuator 300 may include an attenuator pad 308 on the mount plate 302*a*. The attenuator pad 308 may include an elastomeric material such as foam and may have a concave pad portion 310. The concave pad portion 310 may rest against the shoulder of the firearm user during firing of the firearm 200. A center damper assembly 320 may extend between the mount plate 302*a* and the shoulder plate 302*b*. The center damper assembly 320 may include a center damper cavity 322 in the shoulder plate 302*b*. A center damper 328 may engage and extend between the mount plate 302*a* and the center damper cavity 322 in the shoulder plate 302*b*. The center damper 328 may be fabricated of the same material or materials as was heretofore described with respect to the damper 104*a*, 104*b* of the attenuator 100. In some embodiments, damper buttons 324, 326 may be located on the inner diameter of the center damper 328. Grooves on the center damper improve dynamic energy absorption characteristics in some embodiments. At least one center damper fastener 330 may extend through at least one center damper fastener opening (not illustrated) in the mount plate 302*a* and the shoulder plate 302*b* to secure the center damper 328 between the mount plate 302*a* and the shoulder plate 302*b*. In some embodiments, at least one guide rod 314*a*, 314*b* may extend through a respective pair of guide rod openings 304*a*, 304*b*.

Application of the attenuator 300 may be as was heretofore described with respect to application of the attenuator 100 in FIGS. 1A-5. Accordingly, the concave pad portion 310 of the attenuator pad 308 may engage the shoulder of the firearm user as the firearm 200 is fired. The center damper 328 of the center damper assembly 320 may additionally absorb recoil energy along with the damper 304*a*, 304*b* during the primary and secondary recoils of the firearm 200. The attenuator pad 308 may cushion the mount plate 302*a* against the shoulder of the firearm shooter for the comfort of the shooter.

These and other advantages of the invention will be further understood and appreciated by those skilled in the art by reference to the following written specification, claims and appended drawings.

There are polymer additives and processes that increase molecular chain length that lead to improved cold temperature performance and increases energy absorption.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A shoulder-fired firearm primary and secondary recoil attenuator, the attenuator comprising:

a flat, elongated mount plate attachable to a butt of a shoulder-fired firearm;

a flat, elongated shoulder plate disposed in a spaced-apart, parallel relationship with the mount plate;

a pair of spaced-apart damper fasteners extending through the mount plate and the shoulder plate; and a pair of spaced-apart dampers on the damper fasteners, respectively, and disposed between the mount plate and the shoulder plate;

a center damper assembly having a center damper between the pair of spaced-apart dampers and disposed between the mount plate and the shoulder plate, each of the pair of spaced-apart dampers and the center damper comprising:

a viscoelastic copolymer elastomer material having a hollow body elastomer construction, the viscoelastic copolymer elastomer material being shape-engineered to exhibit time-dependent strain, whereby the pair of spaced-apart dampers and the center damper have distinct spring rates in response to a primary recoil impulse caused by acceleration of a bullet traveling through a firearm barrel, and a secondary recoil impulse caused by ejection of the gases exiting the firearm barrel.

2. The attenuator of claim 1, wherein the center damper assembly comprises a center damper cavity in the shoulder plate, a first damper seat in the center damper cavity and a second damper seat on the mount plate in alignment with the first damper seat, and wherein the center damper extends between the first damper seat and the second damper seat.

3. The attenuator of claim 2, further comprising a center damper fastener extending through and between the mount plate and the shoulder plate, and wherein the center damper is mounted on the center damper fastener.

4. The attenuator of claim 1, further comprising an attenuator pad on the mount plate, the attenuator pad having an elastomeric material, and a concave pad portion on the attenuator pad.

* * * * *